US010969112B2

(12) United States Patent
Lamasanu et al.

(10) Patent No.: US 10,969,112 B2
(45) Date of Patent: Apr. 6, 2021

(54) SWITCH FOR A COOKING APPLIANCE

(71) Applicant: Electrolux Home Products, Inc., Charlotte, NC (US)

(72) Inventors: Constantin Lamasanu, Gallatin, TN (US); Lloyd Smith, Carleston, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 895 days.

(21) Appl. No.: 15/264,067

(22) Filed: Sep. 13, 2016

(65) Prior Publication Data

US 2017/0089589 A1 Mar. 30, 2017

Related U.S. Application Data

(60) Provisional application No. 62/232,101, filed on Sep. 24, 2015.

(51) Int. Cl.
*F24C 7/08* (2006.01)
*H05B 1/02* (2006.01)

(52) U.S. Cl.
CPC ..... *F24C 7/087* (2013.01); *H05B 1/0213* (2013.01); *H05B 1/0258* (2013.01)

(58) Field of Classification Search
CPC ..... F24C 7/087; H05B 1/0213; H05B 1/0258
See application file for complete search history.

(56) References Cited

U.S. PATENT DOCUMENTS

| | | | | |
|---|---|---|---|---|
| 2,123,699 | A * | 7/1938 | Kahn | F24C 7/08 219/398 |
| 2,451,576 | A * | 10/1948 | Pearce | H05B 1/0213 219/486 |
| 3,403,244 | A * | 9/1968 | Siegla | F24C 7/087 219/457.1 |
| 6,246,033 | B1 | 6/2001 | Shah | |
| 7,755,465 | B2 | 7/2010 | Yang | |
| 8,258,437 | B2 | 9/2012 | Donarski et al. | |
| 8,344,291 | B2 | 1/2013 | Donarski | |
| 8,344,292 | B2 | 1/2013 | Franca et al. | |
| 8,723,085 | B2 | 5/2014 | Callahan et al. | |
| 9,220,130 | B1 | 12/2015 | Smith | |
| 10,251,214 | B2 * | 4/2019 | Gomez | H05B 1/0213 |
| 2013/0001214 | A1 | 1/2013 | Franca et al. | |
| 2013/0087548 | A1 | 4/2013 | Donarski | |

(Continued)

*Primary Examiner* — Christopher S Kim
(74) *Attorney, Agent, or Firm* — Pearne & Gordon LLP

(57) ABSTRACT

A switch for operating a heating element of a cooking appliance includes a first contact electrically connected with the heating element, a second contact electrically connected with a power source. A bimetal strip is configured to electrically connect and disconnect the first and second contacts. The switch further includes a rotatable cam member having a cam surface for operative engagement with a cam follower. The cam surface has a profile dimension that is at least partially variable about the rotational axis of the cam member and is configured to cause displacement of the cam follower as a function of its rotational orientation to thereby adjust an operating temperature of the heating element. The cam surface is configured such that the operating temperature can be adjusted up to but not beyond a predetermined maximum temperature via rotation of the cam member. Circuits incorporating such a switch also are disclosed.

17 Claims, 15 Drawing Sheets

(56) References Cited

U.S. PATENT DOCUMENTS

| | | | |
|---|---|---|---|
| 2014/0251987 | A1 | 9/2014 | Reay |
| 2016/0010872 | A1 | 1/2016 | Mitsuhiro et al. |
| 2016/0018112 | A1 | 1/2016 | Phillips et al. |

* cited by examiner

SWITCH FOR A COOKING APPLIANCE

CROSS-REFERENCE TO RELATED APPLICATIONS

This application claims the benefit of U.S. Provisional Application No. 62/232,101, filed Sep. 24, 2015, which is incorporated in its entirety herein by reference.

FIELD

The present invention relates generally to a switch for a cooking appliance, and, more particularly, to a switch for electrically connecting and disconnecting a heating element of a cooking appliance with a power source.

BACKGROUND

Typically, heating elements of cooking appliances can reach operating temperatures of several hundred degrees in order to cook foodstuff in cookware. With this comes some inherent risk of burns and fire. For example, if foodstuff within cookware reaches a high enough temperature, the foodstuff can auto-ignite. As another example, if a cookware containing boiling water is heated for too long, the water will boil dry, at which point the cookware temperature will rapidly increase to temperatures that can cause serious burns. It is desirable to prevent cookware and foodstuff, and especially cooking or food oils, from reaching such dangerously high temperatures.

SUMMARY

In accordance with a first aspect, a switch for electrically connecting a power source to a heating element of a cooking appliance is provided. The switch includes a first contact and a second contact, a bimetal strip configured to electrically connect and disconnect the first and second contacts, and a cam member. The cam member is rotatable about a rotational axis and has a cam surface for operative engagement with a cam follower. The cam surface has a profile dimension that varies about the rotational axis such that rotation of the cam member can cause displacement of the cam follower to thereby adjust an operating temperature of the heating element up to but not beyond a predetermined maximum temperature.

In accordance with a second aspect, a cooking appliance has a switch having a first contact that is electrically connected to the heating element, a second contact that is electrically connected to a power source, and a bimetal strip configured to electrically connect and disconnect the first and second contacts. A cam member is rotatable about a rotational axis and has a cam surface for operative engagement with a cam follower. The cam surface has a profile dimension that varies about the rotational axis such that rotation of the cam can cause displacement of the cam follower to thereby adjust an operating temperature of the heating element up to but not beyond a predetermined maximum temperature.

In accordance with a third aspect, a cooking appliance has a first switch assembly electrically coupled to a heating element and configured to selectively operate the heating element at a first operating temperature, and a second switch assembly electrically coupled to the heating element and configured to selectively operate the heating element at a second operating temperature that is greater than the first operating temperature.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION

Figure 1:
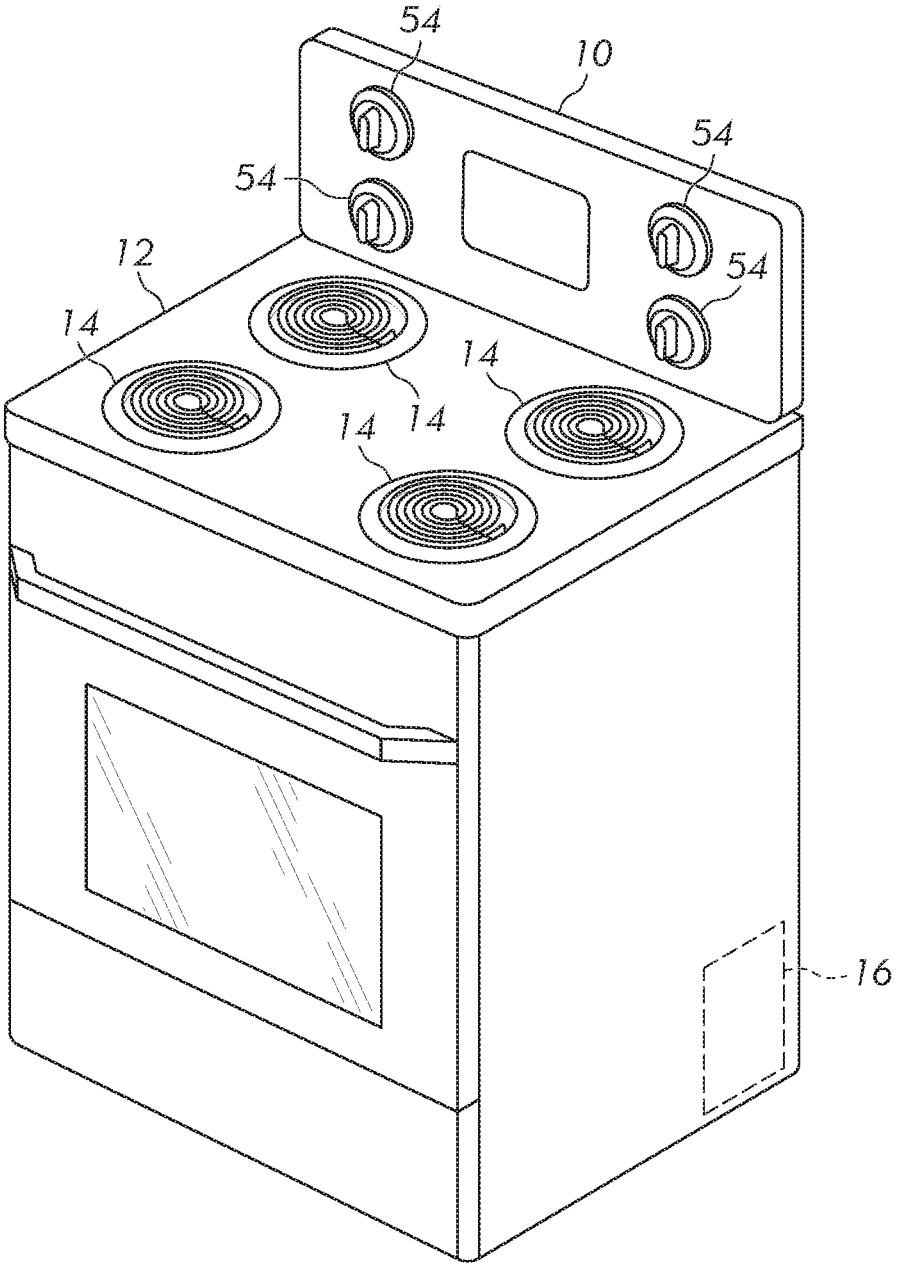
FIG. 1 is a perspective view of an example cooking appliance.

An example cooking appliance 10 is shown in FIG. 1 that includes a housing 12, at least one heating element 14, and a power source 16 for supplying power (e.g., electrical current) to each heating element 14 to generate heat. Each heating element 14 can be any element configured to receive power for heating foodstuff within or on a cookware by conduction, convection, radiation, induction, or some combination thereof. For example, each heating element 14 can include one or more electric-resistance-heating coils.

Figure 2:
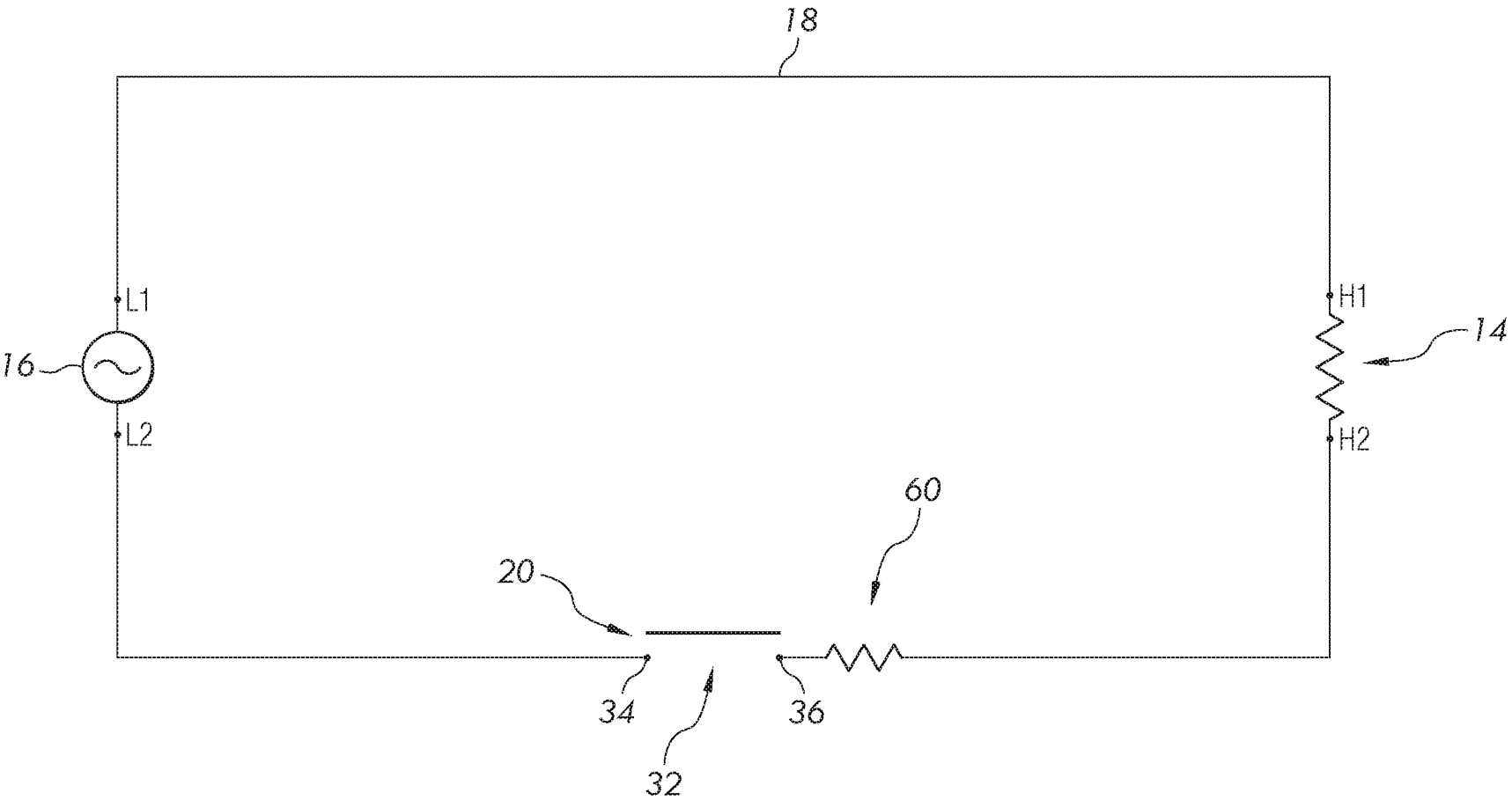
FIG. 2 shows a schematic diagram of a first example power circuit for a heating element of the cooking appliance.

FIG. 2 shows a schematic diagram of an example power circuit 18 for a heating element 14 of the cooking appliance 10. The power circuit 18 includes the heating element 14, the power source 16, and a switch assembly 20 that is configured to selectively open and close the power circuit 18. Moreover, in some examples, the power circuit 18 may include other elements such as, for example, sensors, additional switches, and/or additional heating elements. The power circuit 18 can be any electrical circuit defined at least in part by the heating element 14, power source 16, and switch assembly 20.

When the power circuit 18 is closed, power will be supplied to the heating element 14 from the power source 16, thereby causing the operating temperature of the heating element 14 to rise. (For the purposes of this disclosure, reference to the "operating temperature" of a heating element 14 can mean the temperature of the heating element 14 itself or the temperature of a target item heated by the heating element 14 such as, for example, a cookware disposed on or adjacent the heating element). If the power circuit 18 is later opened, the supply of power to the heating element 14 will cease, thereby causing the operating temperature of the heating element 14 to fall.

If the power circuit 18 is closed and power is supplied persistently for a sufficient amount of time, the operating temperature of the heating element 14 will eventually reach a maximum-operable-temperature of, for example, 700° C. or greater. (For the purposes of this disclosure, reference to the "maximum-operable-temperature" of a heating element 14 means the operating temperature of the heating element 14 during a steady state in which continued supply of power to the heating element 14 from an associated power source will no longer increase the operating temperature). However, it may be desirable to maintain the heating element 14 at an operating temperature below its maximum-operable-temperature. For instance, it has been found that foodstuff such as oils can auto-ignite at certain temperatures such as, for example, 424° C. for canola oil, 406° C. for vegetable oil, and 435° C. for olive oil. Thus, it may be desirable to maintain the heating element 14 at an operating temperature that is equal to or less than the auto-ignition temperature of a foodstuff, in order to ensure that a cookware heated by that element or that foodstuffs inside that cookware do not exceed the auto-ignition temperature.

As will be described in further detail below, the switch assembly 20 is designed to periodically open and close the power circuit 18 in a controlled manner to maintain the operating temperature of the heating element 14 about a desired temperature that is below its maximum-operable-temperature. Moreover, the switch assembly 20 is adjustable so that the operating temperature maintained by the switch assembly 20 can be adjusted. However, the switch assembly 20 is designed so that the operating temperature cannot be adjusted beyond a predetermined maximum temperature. For example, the switch assembly 20 can be designed so that the operating temperature cannot exceed a predetermined maximum temperature that is equal to or less than the auto-ignition temperature of a foodstuff such as, e.g. vegetable oil (406° C.), which should similarly limit the temperature of the foodstuff within an associated cookware being heated by the element 14. Thus, the switch assembly 20 can prevent fires that result from the auto-ignition of foodstuff by limiting the maximum operating temperature of the heating element 14 to a predetermined maximum temperature of, for example, 406° C. However, the predetermined maximum temperature can be any predetermined temperature above or below 406° C. in some examples.

With reference to both FIGS. 2 & 3, the switch assembly 20 will now be described in further detail. The switch assembly 20 includes a switch housing 22. The switch housing 22 could be part of (e.g., formed integrally with) the housing 12 of the cooking appliance 10 or it could be a separate structure that is attached to or otherwise installed within or as part of the appliance housing 12. The switch housing 22 in the illustrated example includes a main body portion 24 and a lid portion 26 that is removably coupled to the main body portion 24 to form an enclosure 28. The lid portion 26 includes an aperture 30 extending therethrough.

The switch assembly 20 further includes a set of contacts 32 including a first contact 34 and a second contact 36 that are electrically connected or connectable to the power source 16 and the heating element 14, respectively. For example, as shown in FIG. 2 the first contact 34 and the second contact 36 can be respectively connected to a terminal L2 of the power source 16 and a terminal 112 of the heating element 14, or vice versa. Alternatively, the first and second contacts 34, 36 can be respectively connected to a terminal L1 of the power source 16 and a terminal 112 of the heating element 14, or vice versa. The first and second contacts 34, 36 can be located anywhere along the power circuit 18 such that one contact is connected to a terminal of the power source 16 and another contact is connected with a terminal of the heating element 14.

Figure 3:
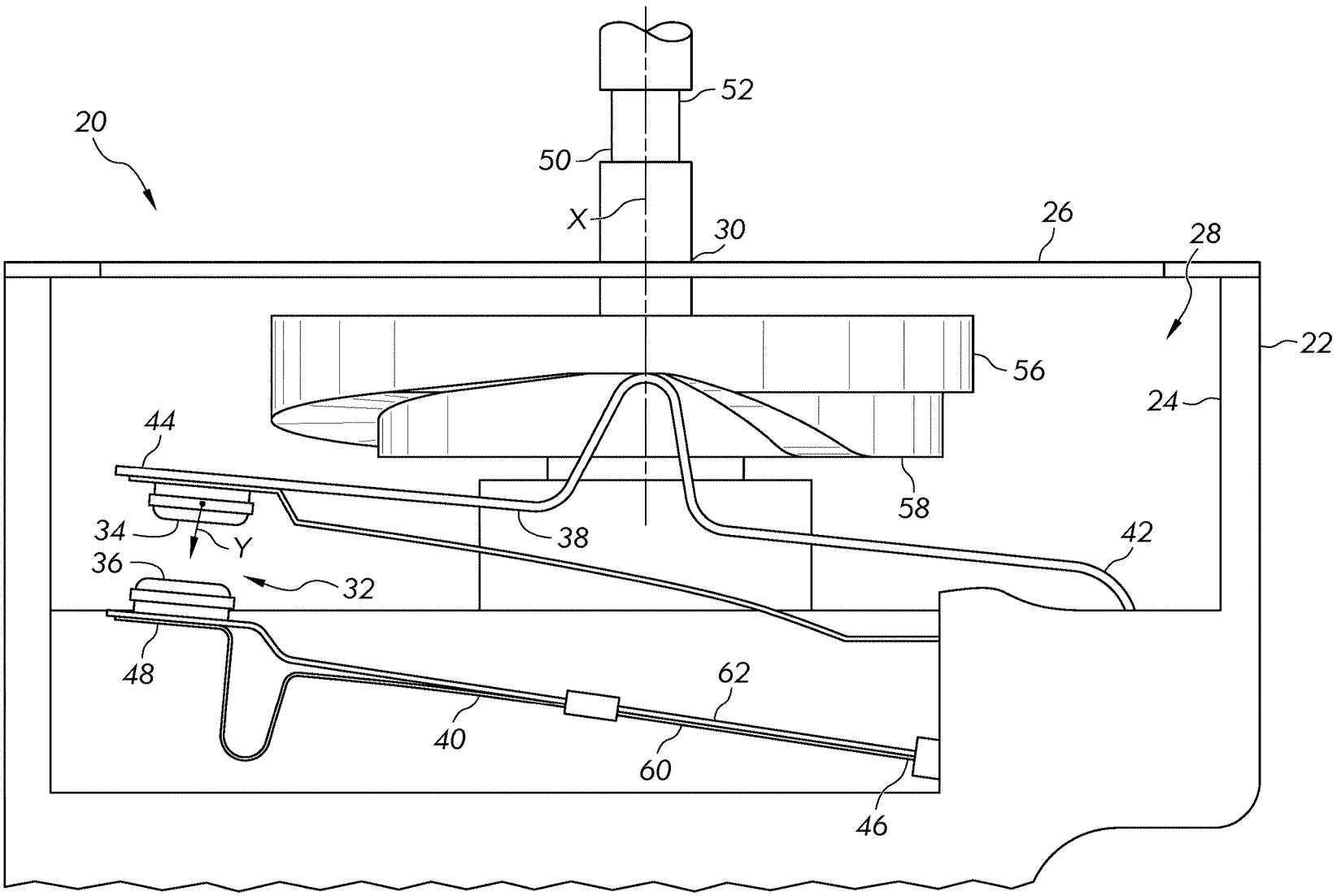
FIG. 3 is cross-sectional view of a switch for a heating element of the cooking appliance.

As shown in FIG. 3, the first and second contacts 34, 36 can be respectively provided on a cam follower 38 and a bimetal strip 40 of the switch assembly 20, or vice versa. The cam follower 38 includes a fixed end portion 42 that is fixed to the switch housing 22 or some other stationary member and a free end portion 44 that is cantilevered from the fixed end portion 42 such that the free end portion 44 can be moved (e.g., pivoted) about the fixed end portion 42. Likewise, the bimetal strip 40 includes a fixed end portion 46 that is fixed to the switch housing 22 or some other stationary member and a free end portion 48 that is cantilevered from the fixed end portion 46 such that the free end portion 48 can be moved (e.g., pivoted) about the fixed end portion 46. Both the cam follower 38 and the bimetal strip 40 can be mounted at their fixed end portions 42, 46 such that their free end portions 44, 48 are biased toward the positions shown in FIG. 3. In the state shown in FIG. 3, the cam follower 38 and the bimetal strip 40 are in an off position wherein the first and second contacts 34, 36 are disconnected, thereby disconnecting the heating element 14 from the power source 16 and opening the power circuit 18.

The power circuit 18 can be closed by moving the free end portion 44 of the cam follower 38 in a direction Y toward the second contact 36 until the first and second contacts 34, 36 contact each other. To control the position of the free end portion 44 of the cam follower 38, the switch assembly 20 includes a cam assembly 50 configured for operative engagement with the cam follower 38. The cam assembly 50 includes a spindle 52 that can be mounted to the switch housing 22 such that the spindle 52 extends through the aperture 30 of the lid portion 26. On the outside of the housing 22 (e.g., above lid portion 26), a knob 54 (shown in FIG. 1) can be coupled to the spindle 52 so a user can rotate the knob 54 and spindle 52 about a rotational axis X.

Meanwhile, on the interior of the housing 22 the cam assembly 50 includes a cam 56 that is coupled to the spindle 52 such that the cam 56 is rotatable with the spindle 52 about the rotational axis X. The cam 56 includes a cam surface 58 that extends circumferentially about the rotational axis X and is positioned such that the cam follower 38 is biased against the cam surface 58. As will be described in further detail below, the cam surface 58 is configured such that rotation of the cam 56 at least partially about the rotational axis X causes displacement of the free end portion 44 of the cam follower 38 either toward or away from the second contact 36.

To operate the heating element 14, the knob 54 can be turned to a position corresponding to a desired operating temperature of the heating element 14. The cam 56 will rotate with the knob 54 and move the cam follower 38 in the direction Y toward the second contact 36 until the first and second contacts 34, 36 connect (i.e., close), thereby closing the power circuit 18 and allowing power to be supplied to the heating element 14 from the power source 16. The operating temperature of the heating element 14 will start rising. At the same time, current will pass through a resistive heat element 60 located approximate (e.g., attached to) the bimetal strip 40, causing the resistive heat element 60 to heat up. The bimetal strip 40 includes an expansion member 62 located proximate to the resistive heat element 60 that will in turn heat up and begin to expand. Eventually, expansion of the member 62 will cause the free end portion 48 of the bimetal strip 40 to deflect away from the first contact 34 such that the first and second contacts 34, 36 disconnect (i.e., open) and the power circuit 18 opens. The cam assembly 50 is designed such that this opening of the power circuit 18 will occur about the same time that the heating element 14 has reached the desired operating temperature, thereby preventing the operating temperature of the heating element 14 from further rising substantially above the desired operating temperature.

The power circuit 18 will remain open for a period of time, causing the operating temperature of the heating element 14 to stop rising and eventually, begin to fall. While the power circuit 18 is open, current will no longer pass through the resistive heat element 60 of the bimetal strip 40. With no current passing through the resistive heat element 60 to generate heat, the expansion member 62 of the bimetal strip 40 will begin to cool and shrink. As the member 62 shrinks, the free end portion 48 of the bimetal strip 40 will deflect back toward the first contact 34. Eventually, the first and second contacts 34, 36 will reconnect (i.e., close), thereby closing the power circuit 18 and allowing current flow to resume. The cam assembly 50 is designed such that this closing of the power circuit 18 will occur before the operating temperature of the heating element 14 drops significantly below the desired operating temperature. The power circuit 18 will then stay closed for a period of time until the free end portion 48 of the bimetal strip 40 again deflects away from the from the first contact 34, causing the first and second contacts 34, 36 to disconnect. In this manner, the switch assembly 20 can regulate the operating temperature of the heating element 14 by cycling the first and second contacts 34, 36 between open and closed states to intermittently provide power to the heating element 14 and maintain the heating element 14 about the desired operating temperature.

The desired operating temperature maintained by the switch assembly 20 can be adjusted by turning the knob 54 to adjust the rotational position of the cam 56. The rotational position of the cam 56 controls the position of the free end portion 44 of the cam follower 38, which in turn controls the operating temperature of the heating element 14 about which the first and second contacts 34, 36 will open and close. More specifically, as the free end portion 44 of the cam follower 38 is displaced in the direction Y toward the second contact 36, the first and second contacts 34, 36 will eventually connect with each other. If the free end portion 44 of the cam follower 38 is further displaced in the direction Y, this will cause the free end portion 48 of the bimetal strip 40 to also move in the direction Y away from its resting position. The further the free end portion 48 of the bimetal strip 40 is moved away from its resting position, the greater the operating temperature of the heating element 14 about which the first and second contacts 34, 36 will open and close because the bimetal strip will need to be deflected a greater degree in the Y direction (as a result of heating the resistor 60) for the contact 36 to escape contact with the contact 34. Conversely, the closer the free end portion 48 of the bimetal strip 40 is to its resting position, the lower the operating temperature of the heating element 14 about which the first and second contacts 34, 36 will open and close. Thus, the operating temperature maintained by the switch assembly 20 can be adjusted by turning the knob 54 to adjust the rotational position of the cam 56 and in turn, the amount of deflection of the free end portion 48 of the bimetal strip 40 from its resting position.

With reference now to FIGS. 4-12, some example configurations for the cam surface 58 of the cam 56 will be described. As mentioned above, the cam surface 58 is designed such that rotation of the cam 56 about the rotational axis X will adjust the position of the free end portion 44 of the cam follower 38, which will control the desired operating temperature of the heating element 14. In the illustrated examples, the cam surface 58 is a generally radial surface, meaning that the cam surface 58 is a surface that extends circumferentially about and radially out from the axis X, although it need not (and in preferred embodiments does not) lie entirely within a common plane. For example, as described below portions of the cam surface 58 can be ramped in order to adjust the position of the cam follower 38 via rotation of the cam assembly 50. The cam surface 58 has a profile dimension that is at least partially variable about the rotational axis X. In the examples shown in FIGS. 4-12, the profile dimension is a height H of the cam surface 58 relative to an imaginary base plane B that is perpendicular to the rotational axis X. The height H of the cam surface 58 at a given point can vary depending on the location of the point about the rotational axis X.

Figure 4:
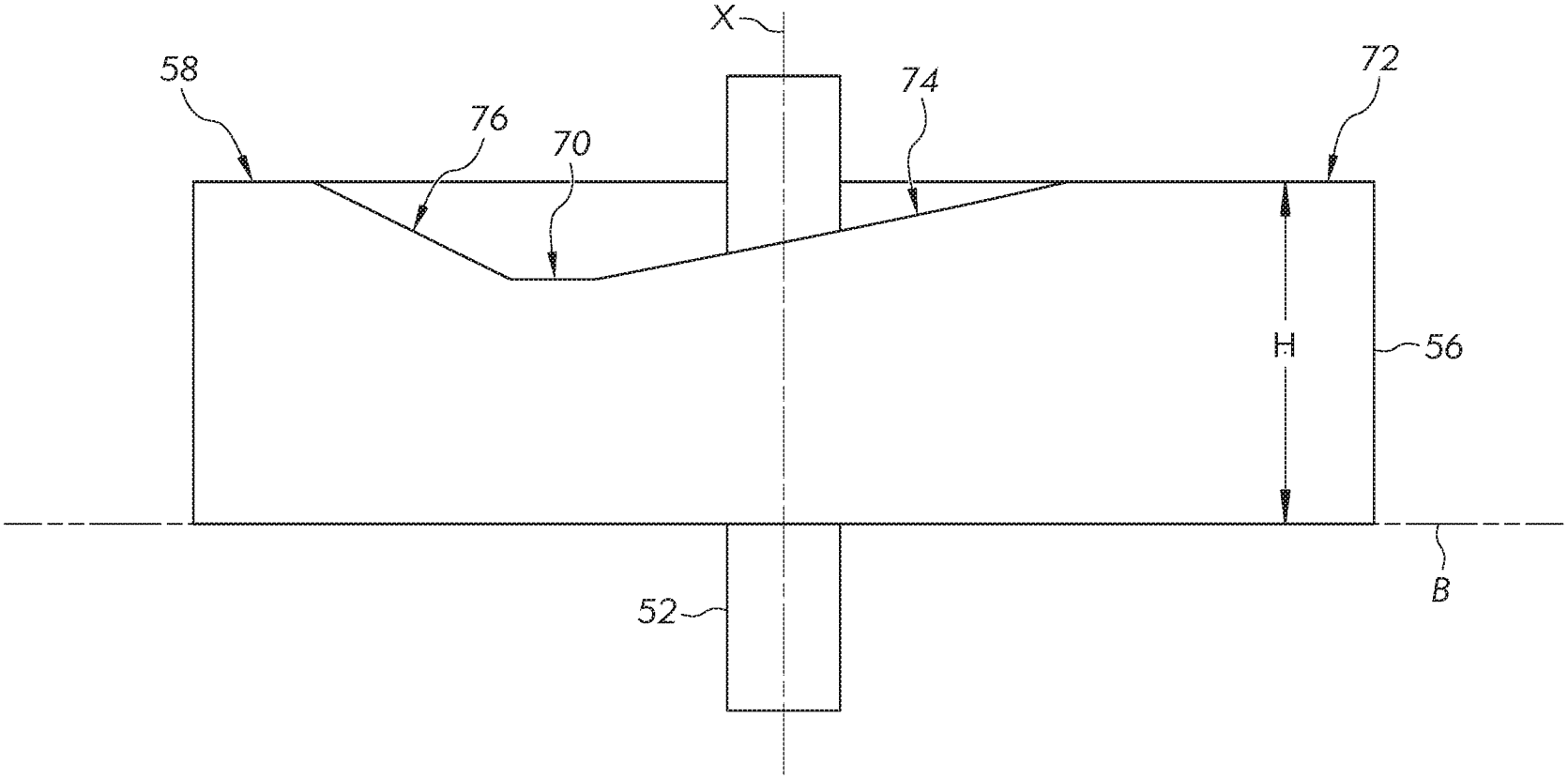
FIG. 4 is a side view of a cam of the switch according to one configuration.
Figure 5:
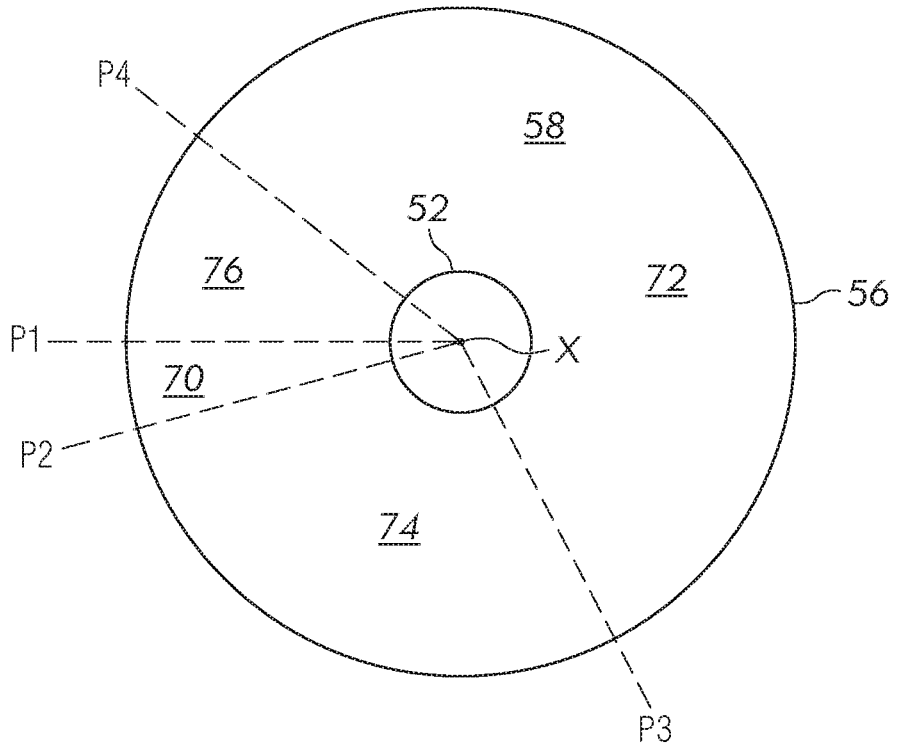
FIG. 5 is a top view of the cam shown in FIG. 4.
Figure 6:
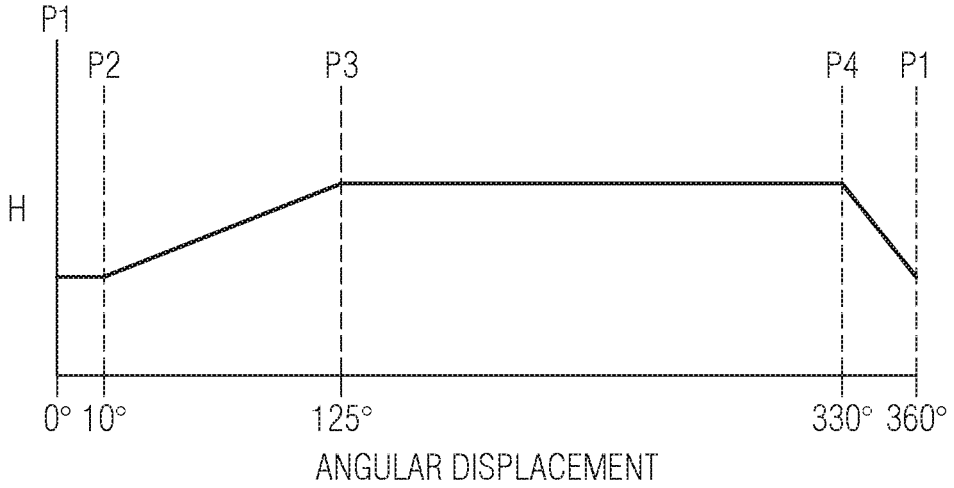
FIG. 6 is a graphical illustration of a profile height of the cam in FIGS. 4 and 5 according to angular displacement from a first axial plane.
Figure 7:
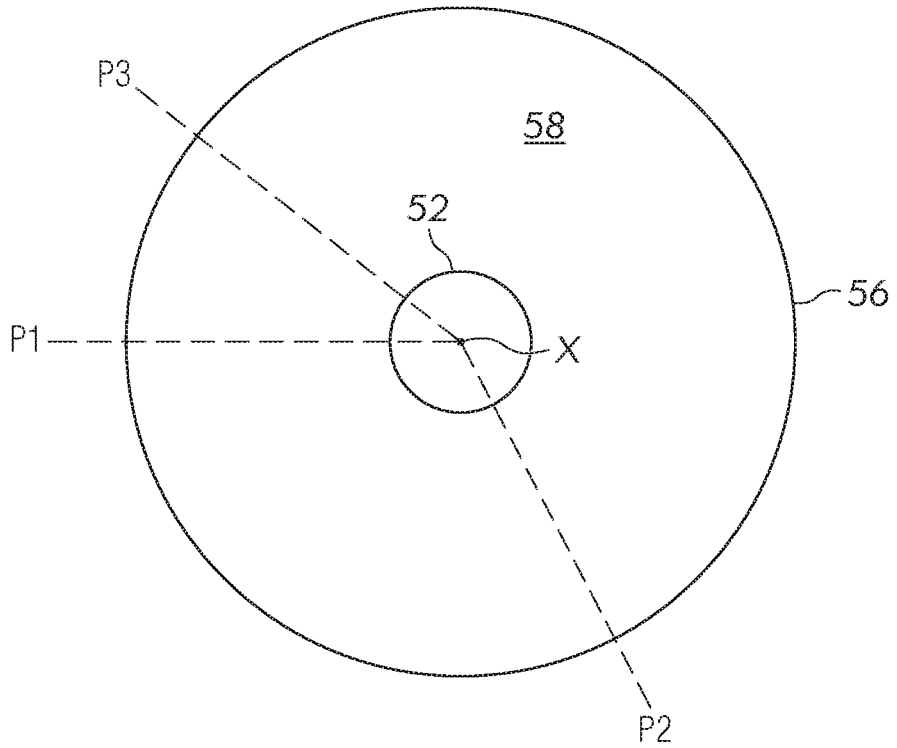
FIG. 7 is a top view of the cam according to another configuration.
Figure 8:
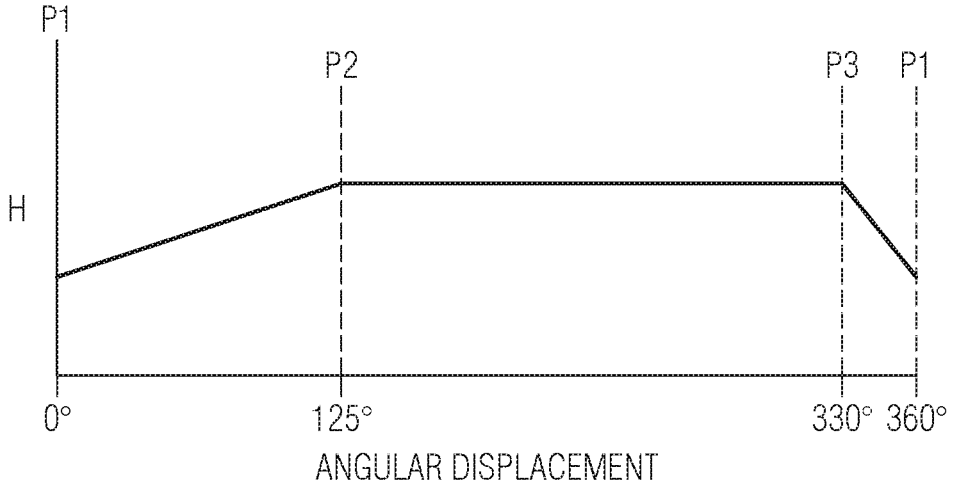
FIG. 8 is a graphical illustration of a profile height of the cam in FIG. 7 according to angular displacement from a first axial plane.
Figure 9:
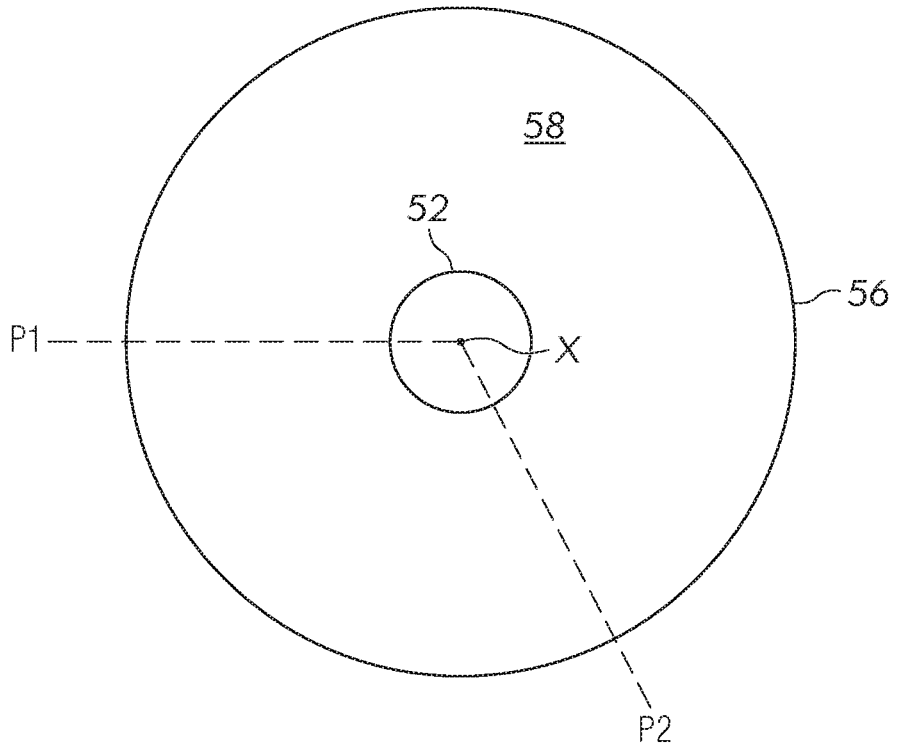
FIG. 9 is a top view of the cam according to yet another configuration.
Figure 10:
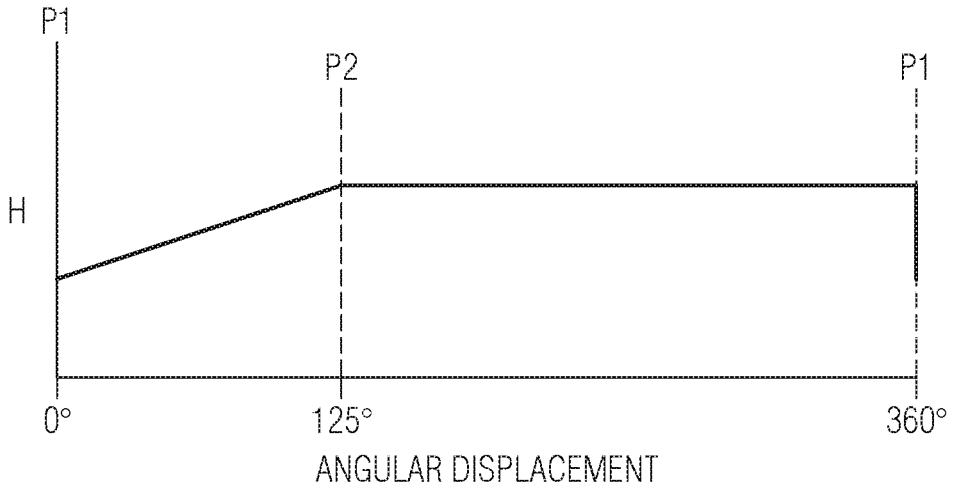
FIG. 10 is a graphical illustration of a profile height of the cam in FIG. 9 according to angular displacement from a first axial plane.
Figure 11:
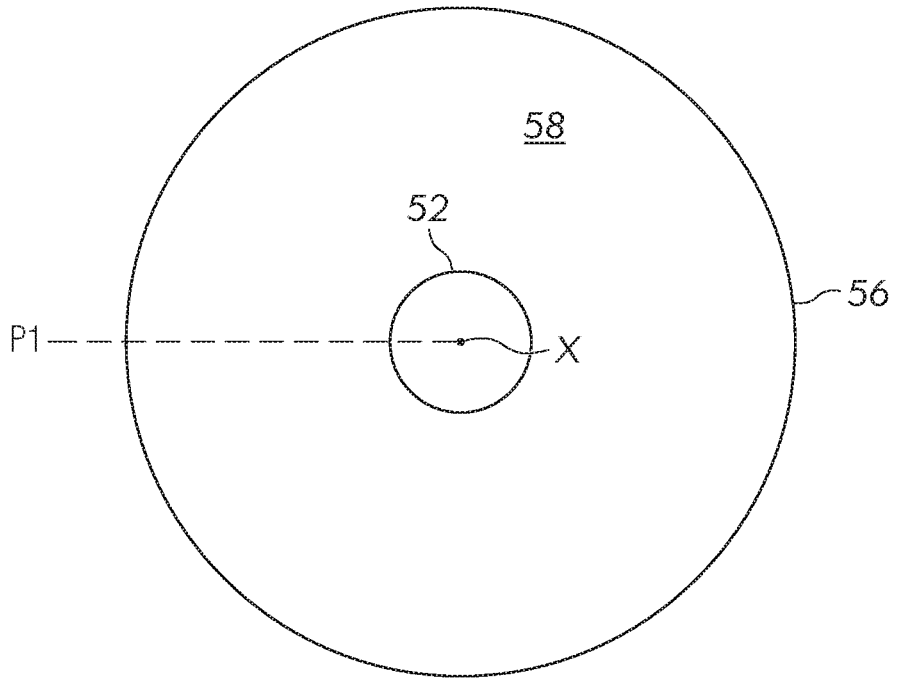
FIG. 11 is a top view of the cam according to still yet another configuration.
Figure 12:
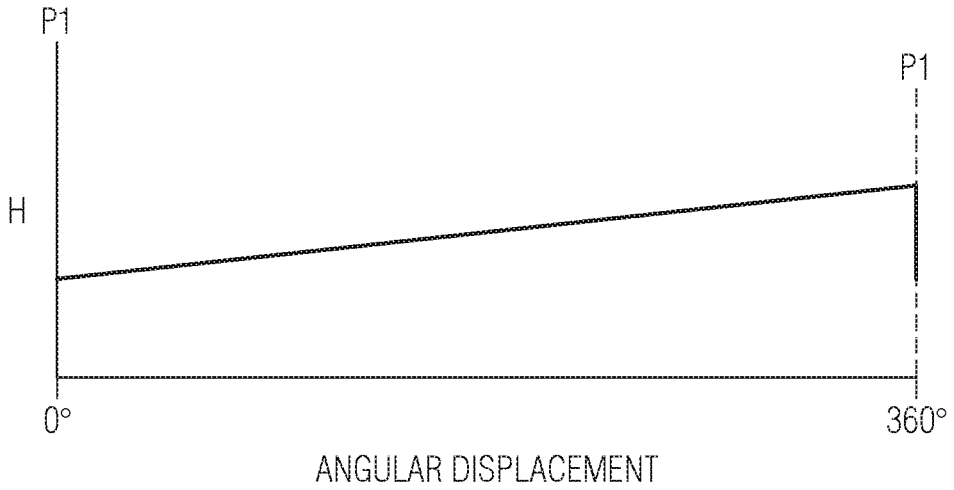
FIG. 12 is a graphical illustration of a profile height of the cam in FIG. 11 according to angular displacement from a first axial plane.

For instance, in the example cam surface 58 shown in FIGS. 4-6, the height H is constant from a first axial plane P1 of the spindle 52 to a second axial plane P2 of the spindle 52 that is angularly displaced from the first axial plane P1 about the rotational axis X, in the illustrated embodiment by about 10°. (For the purposes of this disclosure, an axial plane is an imaginary plane that is parallel to and has an edge defined by the rotational axis X). The height H then increases at a constant rate from the second axial plane P2 to a third axial plane P3, which is angularly displaced from the second axial plane P2 about the rotational axis X, in the illustrated embodiment by about 115°. The height H is then constant from the third axial plane P3 to a fourth axial plane P4 of the spindle 52, which is angularly displaced from the third axial plane P3 about the rotational axis X, in the illustrated embodiment by about 205°. The height H then decreases at a constant rate from the fourth axial plane P4 back to the first axial plane P1 in the illustrated embodiment, in which the first axial plane P1 is angularly displaced from the fourth axial plane P4 about the rotational axis X by about 30°. While constant rates of height change and particular angular displacements of axial planes are noted above in the embodiment shown in FIGS. 4-6, it is to be appreciated that the number of and angular displacements between axial planes, as well as the rates of height change, can vary, for example as seen in other examples herein.

As configured in FIGS. 4-6, the cam surface 58 includes a first flat surface portion 70 between the first axial plane P1 and the second axial plane P2 that is substantially perpendicular with the rotational axis X. A second flat surface portion 72 located between the third axial plane P3 and the fourth axial plane P4 is parallel with and axially spaced from the first flat surface portion 70; i.e. the surfaces of flat surface portions 70 and 72 are at different heights (axially spaced) when viewed from the side, as seen in FIG. 4. The cam surface 58 also includes first and second ramped surface portions 74, 76 that connect the first and second flat surface portions 70, 72. The height H of the first flat surface portion 70 is configured such that when the cam follower 38 engages any portion of the first flat surface portion 70, the cam follower 38 will be positioned so that the first contact 34 on its free end portion 44 does not contact the second contact 36. Thus, the first and second contacts 34, 36 will be disconnected and the switch assembly 20 will be in a persistent open (e.g., off) state. Meanwhile, the height H of the second flat surface portion 72 is configured such that when the cam follower 38 engages any portion of the second flat surface portion 72, the free end portion 44 of the cam follower 38 will be positioned so that the operating temperature of the heating element 14 is a selected maximum temperature; e.g. about 400° C. When the cam follower 38 engages a portion of the first and second ramped surface portions 74, 76, the free end portion 44 of the cam follower 38 will be positioned such that the operating temperature of the heating element 14 is somewhere between ambient temperature and the aforementioned maximum temperature depending on the height H of the ramped portion where it is engaged. Thus, the height H of the cam surface 58 about the rotational axis X is designed so that the operating temperature of the heating element 14 can be adjusted up to but not beyond a predetermined maximum temperature by rotation of the cam 56, wherein the maximum temperature will be determined by the height of the second flat surface portion 72, which in an example embodiment is about 400° C.

FIGS. 7-8, 9-10 and 11-12 show three other examples wherein the cam surface 58 is a radial surface configured such that the operating temperature can be adjusted up to but not beyond a selected maximum operating temperature (e.g., about 400° C.) by rotation of the cam 56 along different operating profiles. In the example shown in FIGS. 7 & 8, the height H of the cam surface 58 increases from a first axial plane P1 to the second axial plane P2, is then constant from the second axial plane P2 to a third axial plane P3, and then decreases from the third axial plane P3 back to the first axial plane P1. In the example shown in FIGS. 9 & 10, the height H of the cam surface 58 increases from a first axial plane P1 to a second axial plane P2 and is then constant from the second axial plane P2 back to the first axial plane P1, where it abruptly decreases back to its lowest height. In the example shown in FIGS. 11 & 12, the height H of the cam surface 58 increases from a first axial plane P1 about the rotational axis until it again reaches the first axial plane P1, at which point the cam surface 58 steps down abruptly to its lowest height. In all of these examples, the height H profile of the cam surface 58 about the rotational axis X is configured so that the operating temperature of the heating element 14 can be adjusted by rotation of the cam 56 up to but not beyond a preselected maximum temperature, which in example embodiments is about 400° C.

Turning now to FIGS. 13-20, some other example configurations for the cam surface 58 of the cam 56 will be described. In these examples, the cam surface 58 is an axial surface, meaning that it follows and defines a perimeter wall of the cam 56 and extends lengthwise of the cam 56, parallel to a rotational axis X of the cam 56 (i.e. the side wall of the cam 56). In these embodiments the cam assembly 50 can be installed such the cam follower 38 is biased against the axial cam surface 58 of the cam 56 in a radial direction toward the rotational axis X. The cam surface 58 in these embodiments has a profile dimension in the form of a radius R that is at least partially variable about the rotational axis X. The radius R at a given point along the cam surface 58 is the shortest linear distance from that point to the rotational axis X; i.e., a radius extending from the axis X. The radius R of the cam surface 58 can vary depending on the location about the rotational axis X.

Figure 13:
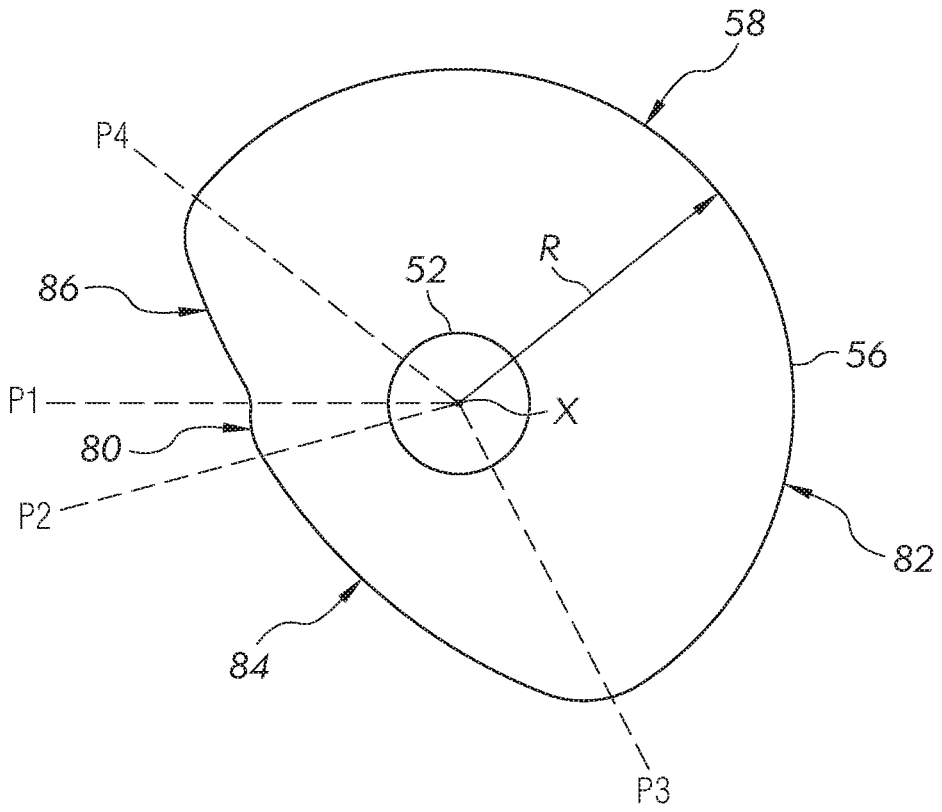
FIG. 13 is a top view of the cam according to another configuration.
Figure 14:
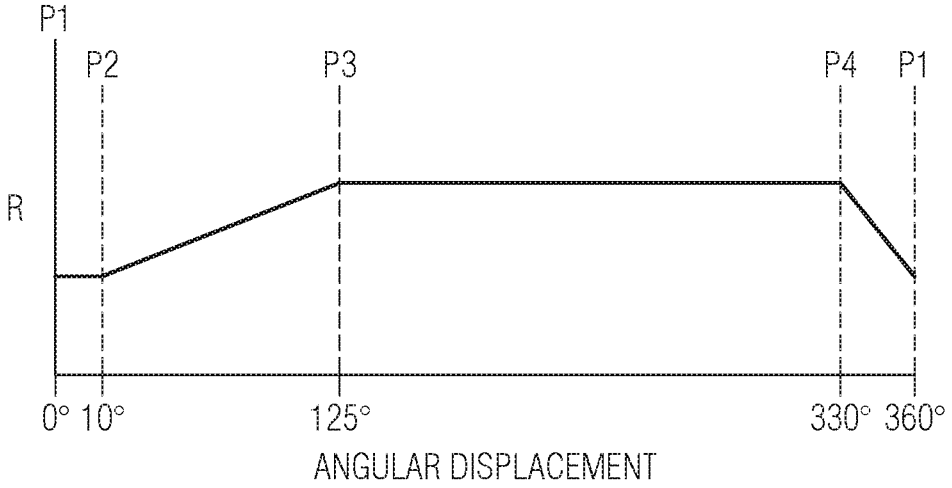
FIG. 14 is a graphical illustration of a profile radius of the cam in FIG. 13 according to angular displacement from a first axial plane.
Figure 15:
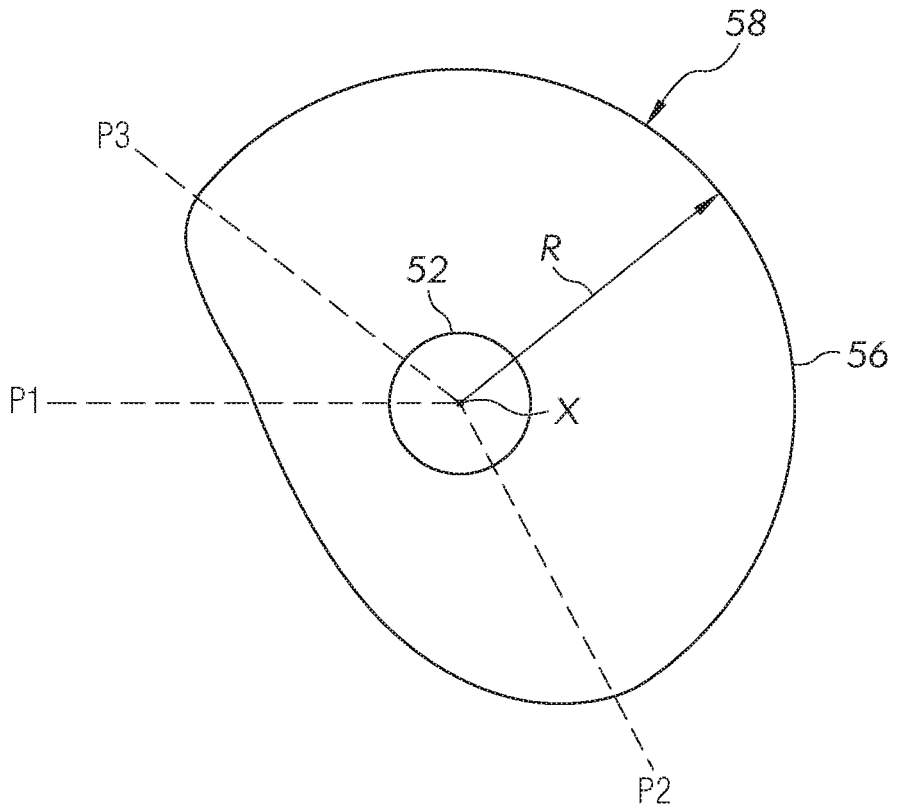
FIG. 15 is a top view of the cam according to yet another configuration.
Figure 16:
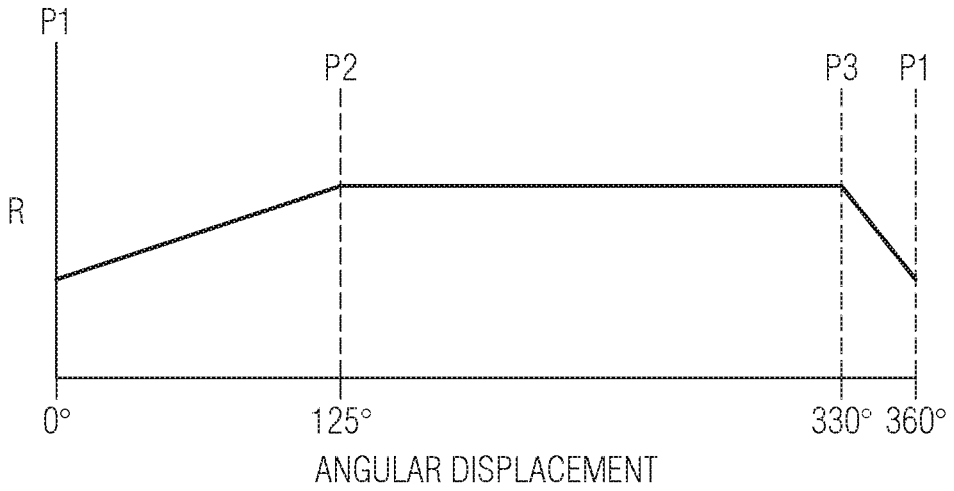
FIG. 16 is a graphical illustration of a profile radius of the cam in FIG. 15 according to angular displacement from a first axial plane
Figure 17:
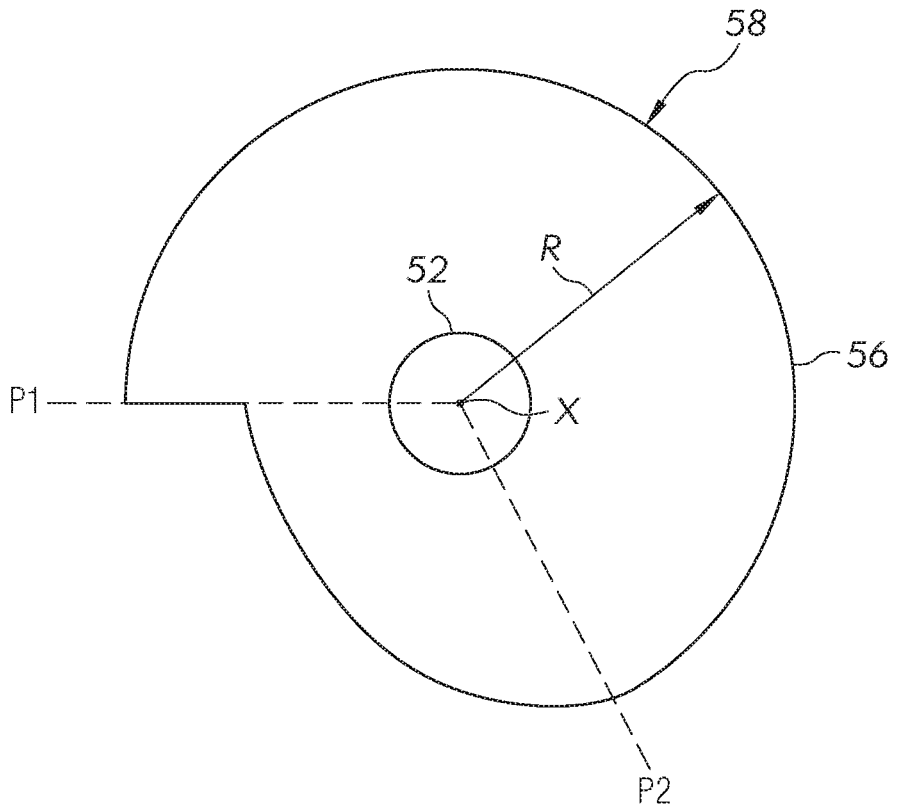
FIG. 17 is a top view of the cam according to still yet another configuration.
Figure 18:
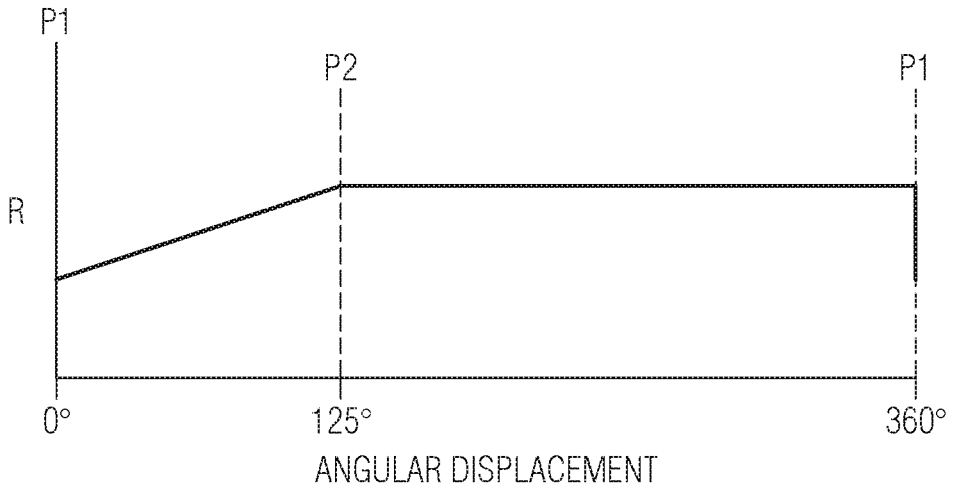
FIG. 18 is a graphical illustration of a profile radius of the cam in FIG. 17 according to angular displacement from a first axial plane
Figure 19:
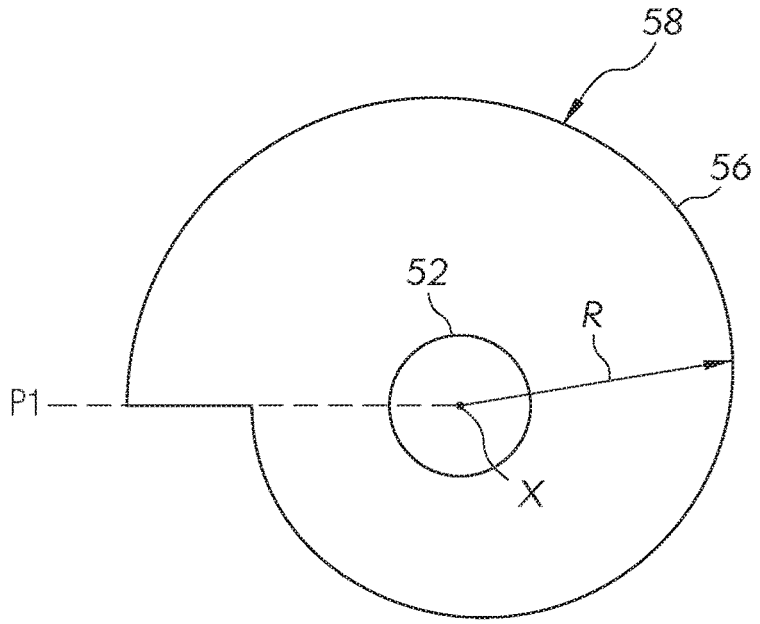
FIG. 19 is a top view of the cam according to another configuration.
Figure 20:
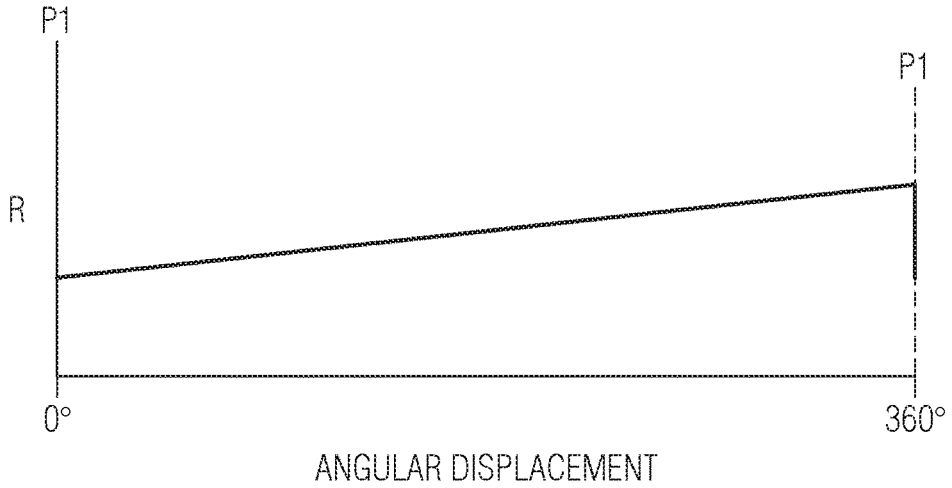
FIG. 20 is a graphical illustration of a profile radius of the cam in FIG. 19 according to angular displacement from a first axial plane.

In the example cam surface 58 shown in FIGS. 13 & 14, the radius R is constant from a first axial plane P1 (defined relative to the axis X in the figure similarly as above) to a second axial plane P2, which is angularly displaced from the first axial plane P1 about the rotational axis X by about 10° in the illustrated embodiment. The radius R then increases at a constant rate from the second axial plane P2 to a third axial plane P3, which is angularly displaced from the second axial plane P2 about the rotational axis X by about 115° in the illustrated embodiment. The radius R is then constant from the third axial plane P3 to a fourth axial plane P4, which is angularly displaced from the third axial plane P3 about the rotational axis X by about 205° in the illustrated embodiment. The radius R then decreases at a constant rate from the fourth axial plane P4 back to the first axial plane P1. As in the earlier examples, it is to be appreciated that the number of and angular displacements between axial planes, as well as the rates of radius change, can vary.

When configured as shown in FIGS. 13 & 14, the cam surface 58 includes a first constant radius portion 80 between the first axial plane P1 and the second axial plane P2 and a second constant radius portion 82 between the third axial plane P3 and the fourth axial plane P4 that has a greater radius than the first constant radius portion 80. The cam surface 58 also includes first and second variable radius portions 84, 86 that connect the first and second constant radius portions 80, 82. The radius R of the first constant radius portion 80 is configured such that when the cam follower 38 engages any portion of the first constant radius portion 80, the free end portion 44 of the cam follower 38 will be positioned so that the first contact 34 does not contact the second contact 36. Thus, the first and second contacts 34, 36 will be disconnected and the switch assembly 20 will be in a persistent open state. Meanwhile, the radius R of the second constant radius portion 82 is configured such that when the cam follower 38 engages any portion of the second constant radius portion 82, the free end portion 44 of cam follower 38 will be positioned so that the operating temperature of the heating element 14 is permitted to reach a preselected maximum temperature, e.g. about 400° C. When the cam follower 38 engages a portion of the first and second variable radius portions 84, 86, the free end portion 44 of cam follower 38 will be positioned such that the operating temperature of the heating element 14 is somewhere between ambient temperature and the preselected maximum temperature depending on the radius R at the specific location being engaged. Thus, the radius R of the cam surface 58 about the rotational axis X is designed so that the operating temperature of the heating element 14 can be adjusted by rotation of the cam 56 up to a preselected maximum temperature, which in example embodiments is about 400° C.

FIGS. 15-20 show other examples wherein the cam surface 58 is an axial surface configured to permit adjustment of the operating temperature up to a preselected maximum temperature by rotation of the cam 56. In the example shown in FIGS. 15 & 16, the radius R of the cam surface 58 increases from a first axial plane P1 to a second axial plane P2, is then constant from the second axial plane P2 to a third axial plane P3, and then decreases from the third axial plane P3 back to the first axial plane P1. In the example shown in FIGS. 17 & 18, the radius R of the cam surface 58 increases from a first axial plane P1 to a second axial plane P2 and is then constant from the second axial plane P2 back to the first axial plane P1, where it abruptly decreases back to its lowest value. In the example shown in FIGS. 19 & 20, the radius R of the cam surface 58 increases from a first axial plane P1 all the way about the rotational axis X and back to the first axial plane P1, at which point it steps down abruptly back to its minimum value. In all of the examples just discussed, the radius R of the cam surface 58 about the rotational axis X is designed so that the operating temperature of the heating element 14 can be adjusted by rotation of the cam 56 up to but not beyond a preselected maximum temperature, e.g. about 400° C.

The switch assembly 20 and power circuit 18 described above are designed to prevent fires that result from the auto-ignition of foodstuff by prohibiting the heating element 14 from reaching its maximum-operable-temperature, which can be several hundreds of degrees Celsius higher than the auto-ignition temperature of a foodstuff. In particular, the switch assembly 20 and power circuit 18 are designed so that the operating temperature of the heating element 14 can be adjusted up to but not beyond a predetermined maximum temperature that is equal to or less than, for example, 400° C. However, limiting the maximum operating temperature of the heating element 14 as such can negatively affect certain cooking operations. For example, the time required to boil water in a cooking vessel will be considerably longer when operating a heating element at 400° C. compared to 700° C. Thus, another example power circuit is described below that will normally limit the maximum operating temperature of the heating element 14 to a predetermined temperature (e.g., 400° C.). But in select circumstances such circuit can be temporarily operated to permit higher heating-element temperatures to improve cooking performance.

Figure 21:
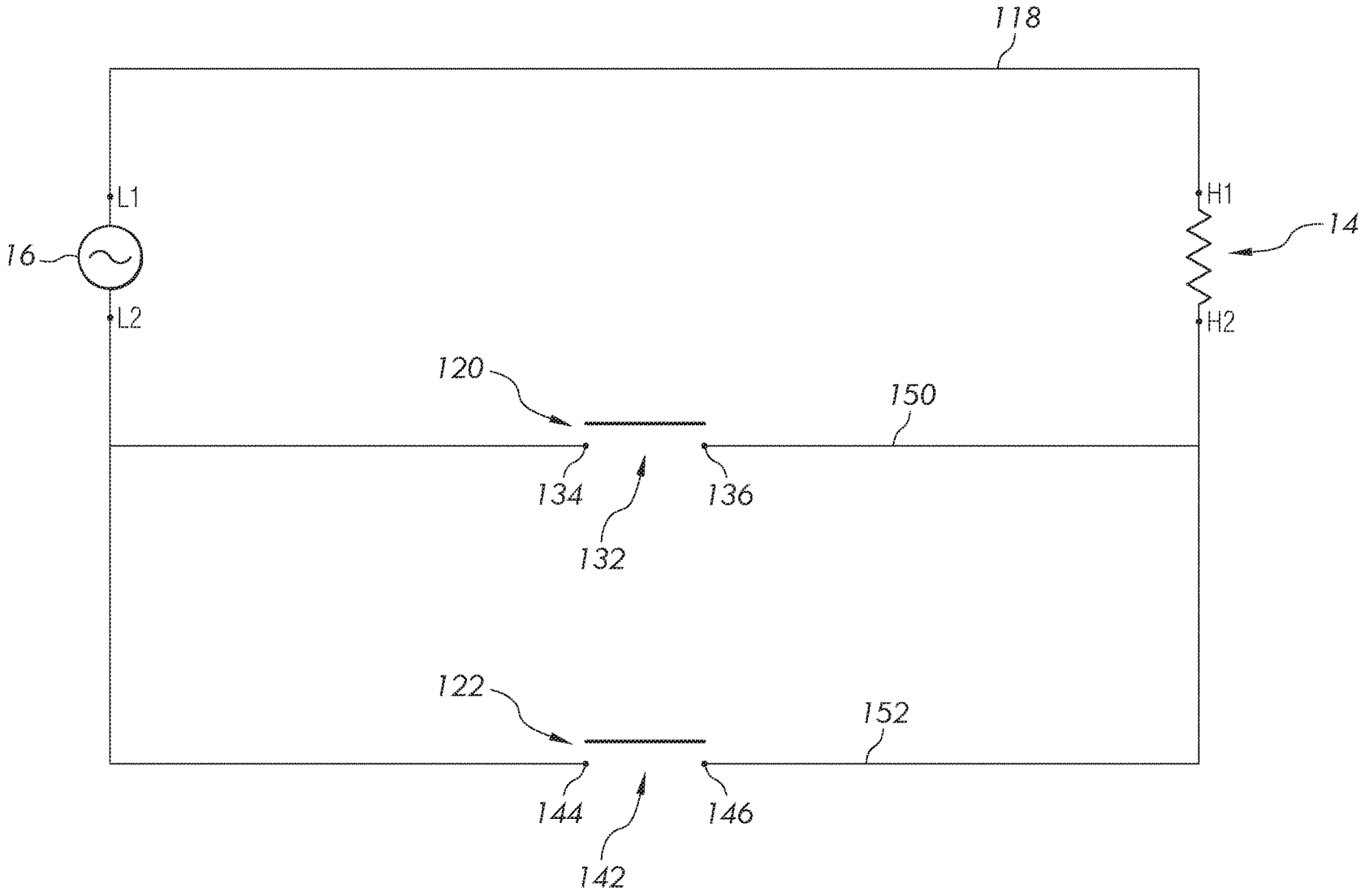
FIG. 21 shows a schematic diagram of a second example power circuit for a heating element of the cooking appliance according to one embodiment.

Turning to FIG. 21, an example configuration of a power circuit 118 is illustrated that includes the heating element 14 and two switch assemblies 120, 122 that are each electrically coupled in parallel between the heating element 14 and the power source 16, though the switch assemblies 120, 122 may be coupled to respective power sources in other examples. The power circuit 118 includes a primary circuit 150 that is defined at least in part by the first switch assembly 120, the heating element 14 and the first switch assembly's associated power source (e.g., power source 16). Moreover, power circuit 118 includes a bypass circuit 152 that is defined at least in part by the second switch assembly 122, the heating element 14 and the second switch assembly's associated power source (e.g., power source 16). It is to be appreciated that the power circuit 118 can include other elements not shown in the illustrated embodiment such as, for example, sensors, additional switches, and/or additional heating elements. Moreover, these additional elements may be provided along the primary circuit 150 and/or the bypass circuit 152. Indeed, other embodiments will be described below that include additional switches and sensors.

As will be described in further detail below, the first switch assembly 120 is configured to selectively operate the heating element 14 at a first operating temperature and the second switch assembly 122 is configured to selectively operate the heating element 14 at a second operating temperature that is greater than the first operating temperature. In particular, the first switch assembly 120 can be engaged to operate the heating element 14 at a first temperature that is, for example, below the maximum-operable-temperature of the heating element 14 and preferably, equal to or less than 400° C. Meanwhile, the second switch assembly 122 can be engaged during other operations when it is desirable to operate the heating element 14 at a second temperature higher than the first temperature maintained by the first switch assembly 120. (For the purposes of this disclosure, a switch assembly is "engaged" when its operative contacts are closed and/or automatically cycling between open and closed states, thereby allowing current to continuously or periodically pass through the contacts. Moreover, a switch assembly is "disengaged" when its operative contacts are open and are not automatically cycling between open and closed states, thereby persistently prohibiting current from passing through the contacts).

More specifically, the first switch assembly 120 includes a set of contacts 132 having two contacts 134, 136 that are connected in series between the heating element 14 and the switch assembly's associated power source. The second switch assembly 122 includes a set of contacts 142 having two contacts 144, 146 that are also connected in series between the heating element 14 and the switch assembly's associated power source. For example, the two contacts 134, 136 of the first switch assembly 120 can be respectively connected to the terminal L2 of the power source 16 and the terminal 112 of the heating element 14, or vice versa. Meanwhile, the two contacts 144, 146 of the second switch assembly 122 can also be respectively connected to the terminal L2 of the power source 16 and the terminal 112 of the heating element 14, or vice versa. Thus, the sets of contacts 132, 142 of the first and second switch assemblies 120, 122 can be electrically connected in parallel between the terminal L2 of the power source 16 and the terminal 112 of the heating element 14. In an alternative example, the two contacts 134, 136 of the first switch assembly 120 can be respectively connected to the terminal L1 of the power source 16 and the terminal H1 of the heating element 14, or vice versa. Meanwhile, the two contacts 144, 146 of the second switch assembly 122 can also be respectively connected to the terminal L1 of the power source 16 and the terminal H1 of the heating element 14, or vice versa. Thus, the sets of contacts 132, 142 of the first and second switch assemblies 120, 122 can be electrically connected in parallel between the terminal L1 of the power source 16 and the terminal H1 of the heating element 14. However, the sets of contacts 132, 142 of the first and second switch assemblies 120, 122 can be arranged differently in other examples to electrically connect the same or different power sources to the same or different terminals of the heating element 14.

Normally, the second switch assembly 122 will be disengaged such that its contacts 144, 146 are disconnected and non-cycling, thereby maintaining the bypass circuit 152 in a persistently open state. With the second switch assembly 122 disengaged and the bypass circuit 152 open, the first switch assembly 120 can be selectively engaged to operate the heating element 14 at a predetermined temperature. For instance, the first switch assembly 120 can be configured similarly or identically to the switch assembly 20 described above such that rotation of a cam will cause the two contacts 134, 136 of the first switch assembly 120 to connect, thereby closing the primary circuit 150 and allowing power to be delivered to the heating element 14 from the power source 16 via the primary circuit 150. The first and second contacts 134, 136 can then be cycled between open and closed states using a bimetal strip and resistive heat element as described above, thereby cycling power from the power source 16 to the heating element 14 through the primary circuit 150 in a manner that maintains the heating element 14 at a desired operating temperature. However, other structure can be provided to initially connect the two contacts 134, 136 of the first switch assembly 120 and then cycle the contacts 134, 136 between open and closed states such as, for example, a programmable logic controller.

The operating temperature maintained by the first switch assembly 120 can be fixed or adjustable. For example, the first switch assembly 120 can be similarly or identically configured to the switch assembly 20 described above such that rotation of a cam will adjust the operating temperature maintained by the first switch assembly 120. In particular, a cam surface of the cam can be designed as described above so that the desired operating temperature can be adjusted up to but not beyond a predetermined maximum temperature. Preferably, the predetermined maximum temperature is less than a maximum-operable-temperature of the heating element and in particular, less than or equal to about 400° C. However, other temperatures and temperature ranges are possible in other embodiments. Moreover, the operating temperature maintained by the first switch assembly 120 can be adjustable using other structure such as, for example, a user interface for a programmable logic controller. Furthermore, in some examples, the first switch assembly 120 may be non-adjustable and will maintain the heating element 14 at a fixed operating temperature that is, for example, equal to or less than about 400° C.

When operating the heating element 14, the first switch assembly 120 can prevent fires that result from the auto-ignition of foodstuff by limiting the maximum operating temperature of the heating element 14 to a predetermined maximum temperature of, for example, 400° C. However, it may be desirable to temporarily operate the heating element 14 at a higher temperature for certain cooking operations. Accordingly, in such cases, the second switch assembly 122 can be selectively engaged to bypass the first switch assembly 120 and to persistently energize the heating element 14 so as to operate the heating element 14 at a higher temperature.

More specifically, the second switch assembly 122 can be selectively engaged to connect its contacts 144, 146, thereby closing the bypass circuit 152 and allowing power to be delivered to the heating element 14 from the power source 16 via the bypass circuit 152 regardless of the state of the switch assembly 120. For instance, the second switch assembly 122 can be configured similarly or identically to the switch assembly 20 described above such that rotation of a cam will cause the two contacts 144, 146 of the second switch assembly 122 to connect. Alternatively, the second switch assembly 122 can include a toggle switch that can be manually switched to connect the two contacts 144, 146. The second switch assembly 122 can include various types of structure for selectively connecting the two contacts 144, 146.

When engaged, the second switch assembly 122 is configured to provide either cycled or non-cycled power to the heating element 14 via the bypass circuit 152. For instance, in the present example, the second switch assembly 122 is configured such that when engaged, the contacts 144, 146 will remain persistently closed, thereby allowing non-cycled power to be delivered from the power source 16 to the heating element 14 via the bypass circuit 152. If power is supplied persistently via the bypass circuit 152 for a sufficient amount of time, the operating temperature of the heating element 14 will eventually reach its maximum-operable-temperature. Thus, the second switch assembly 122 can be selectively engaged to operate the heating element 14 at its maximum-operable-temperature.

In other examples, the second switch assembly 122 can be configured such that when engaged, its contacts 144, 146 will cycle between open and closed states to provide a cycled power through the bypass circuit 152 that maintains the heating element 14 at a desired operating temperature. For instance, the contacts 144, 146 can be cycled using a bimetal strip and resistive heat element as described above or the contacts 144, 146 can be cycled using other structure such as, for example, a programmable logic controller. In such examples, the operating temperature maintained by the second switch assembly 122 can be fixed or adjustable. Whether the operating temperature is fixed or adjustable, the second switch assembly 122 is preferably configured such that when engaged, the second switch assembly 122 will operate the heating element 14 at a temperature greater than the maximum operating temperature maintained by the first switch assembly 120.

In the example configuration shown in FIG. 21, the power circuit 118 is configured such that when both the first and second switch assemblies 120, 122 are disengaged, the heating element 14 will be off and no power will be cycled through the heating element 14. To operate the heating element 14, the first switch assembly 120 can be engaged while the second switch assembly 122 is disengaged to deliver power from the power source 16 to the heating element 14 via the primary circuit 150. In this state (i.e., safe mode), the operating temperature of the heating element 14 will be controlled by the first switch assembly 120. More specifically, the two contacts 134, 136 of the first switch assembly 120 will periodically open and close to cycle power from the power source 16 to the heating element 14 through the primary circuit 150 in a manner that maintains the heating element 14 at a desired operating temperature. As discussed above, the desired operating temperature can be fixed or adjustable up to but not beyond a predetermined maximum temperature. If adjustable, the predetermined maximum temperature will be preferably less than the heating element's maximum-operable-temperature and in particular, less than or equal to about 400° C. If fixed, the fixed operating temperature likewise will be preferably less than the heating element's maximum-operable-temperature and in particular, less than or equal to about 400° C.

When it is desired to operate the heating element 14 at a temperature beyond the maximum operating temperature permitted by the first switch assembly 120, the second switch assembly 122 can be engaged to deliver non-cycled power from the power source 16 to the heating element 14 via the bypass circuit 152. In this state (i.e., boost mode), power will be continuously supplied to the heating element 14 via the bypass circuit 152, causing its operating temperature to rise and exceed the maximum operating temperature permitted by the first switch assembly 120. If power is supplied persistently for a sufficient amount of time, the operating temperature of the heating element 14 will eventually reach its maximum-operable-temperature (e.g., 700°

C.). Thus, the second switch assembly 122 can be selectively engaged to operate the heating element 14 at its maximum-operable-temperature.

When it is no longer desired to operate the heating element 14 at a temperature beyond the maximum operating temperature permitted by the first switch assembly 120, the second switch assembly 122 can be disengaged to open the bypass circuit 152. The first switch assembly 120 will then control the operating temperature of the heating element 14 in safe mode until the second switch assembly 122 is re-engaged or the first switch assembly 120 is disengaged.

Figure 22:
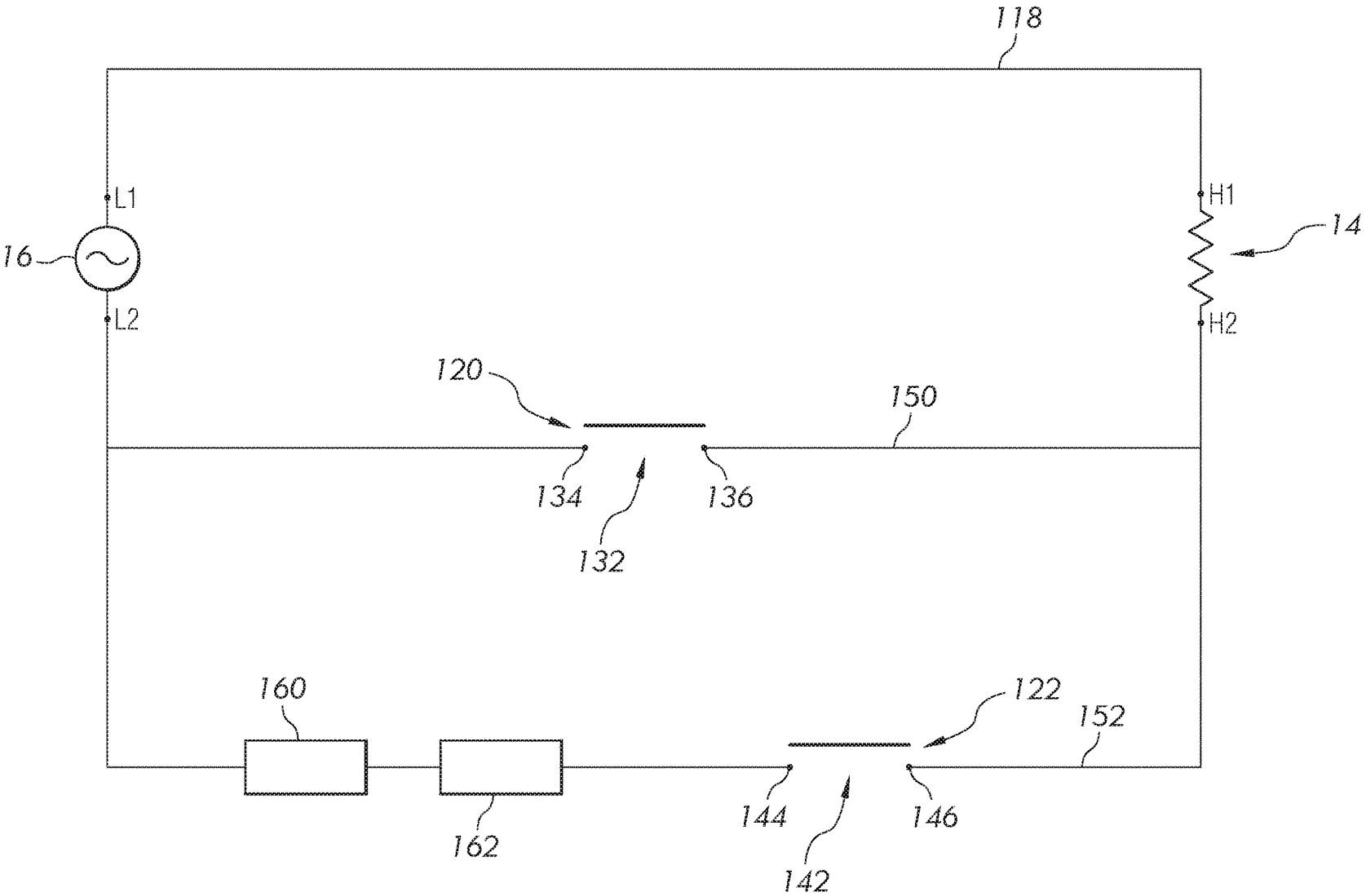
FIG. 22 shows a schematic diagram of the second example power circuit according to another embodiment.

In some cases, it may be desirable to limit the time that the heating element 14 is permitted to be operated in boost mode. Thus, in some examples, the power circuit 118 can include a timer 160, as shown in FIG. 22. The timer 160 can be connected in series with the second switch assembly 122 and is configured such that when the second switch assembly 122 and the power circuit 118 enters boost mode, the timer 160 will begin to count. After the second switch assembly 122 has been engaged and the bypass circuit 152 has been active for a predetermined amount of time, the timer 160 can be configured to disengage the second switch assembly 122, thereby opening the bypass circuit 152 and returning the power circuit 118 to safe mode. For example, the timer 160 can include a relay that will disconnect the contacts 144, 146 of the second switch assembly 122 after the second switch assembly 122 has been engaged for the predetermined amount of time. The first switch assembly 120 will then control the operating temperature of the heating element 14 in safe mode until the second switch assembly 122 is re-engaged manually or the first switch assembly 120 is disengaged.

In some cases, it may be desirable to prevent or discontinue operation of the heating element 14 in boost mode if a user is not near the appliance 10. Thus, as further shown in FIG. 22, the power circuit 118 can include a proximity sensor 162 that is configured to detect the presence or absence of a user within an area proximal to the appliance 10 and control engagement of the second switch assembly 122 based on the detected presence or absence of the user. For instance, if the power circuit 118 is in safe mode and the proximity sensor 162 detects that a user is absent (i.e., not present), the proximity sensor 162 can be configured to prohibit engagement of the second switch assembly 122 such that the power circuit 118 cannot enter boost mode. In addition or alternatively, if the power circuit 118 is in boost mode and the proximity sensor 162 detects that a user is absent (i.e., not present), the proximity sensor 162 can be configured to disengage the second switch assembly 122, either immediately or after the user is absent for a predetermined amount of time, thereby returning the power circuit 118 to safe mode. The first switch assembly 120 will then control the operating temperature of the heating element 14 until the second switch assembly 122 is re-engaged manually or the first switch assembly 120 is disengaged.

Figure 23:
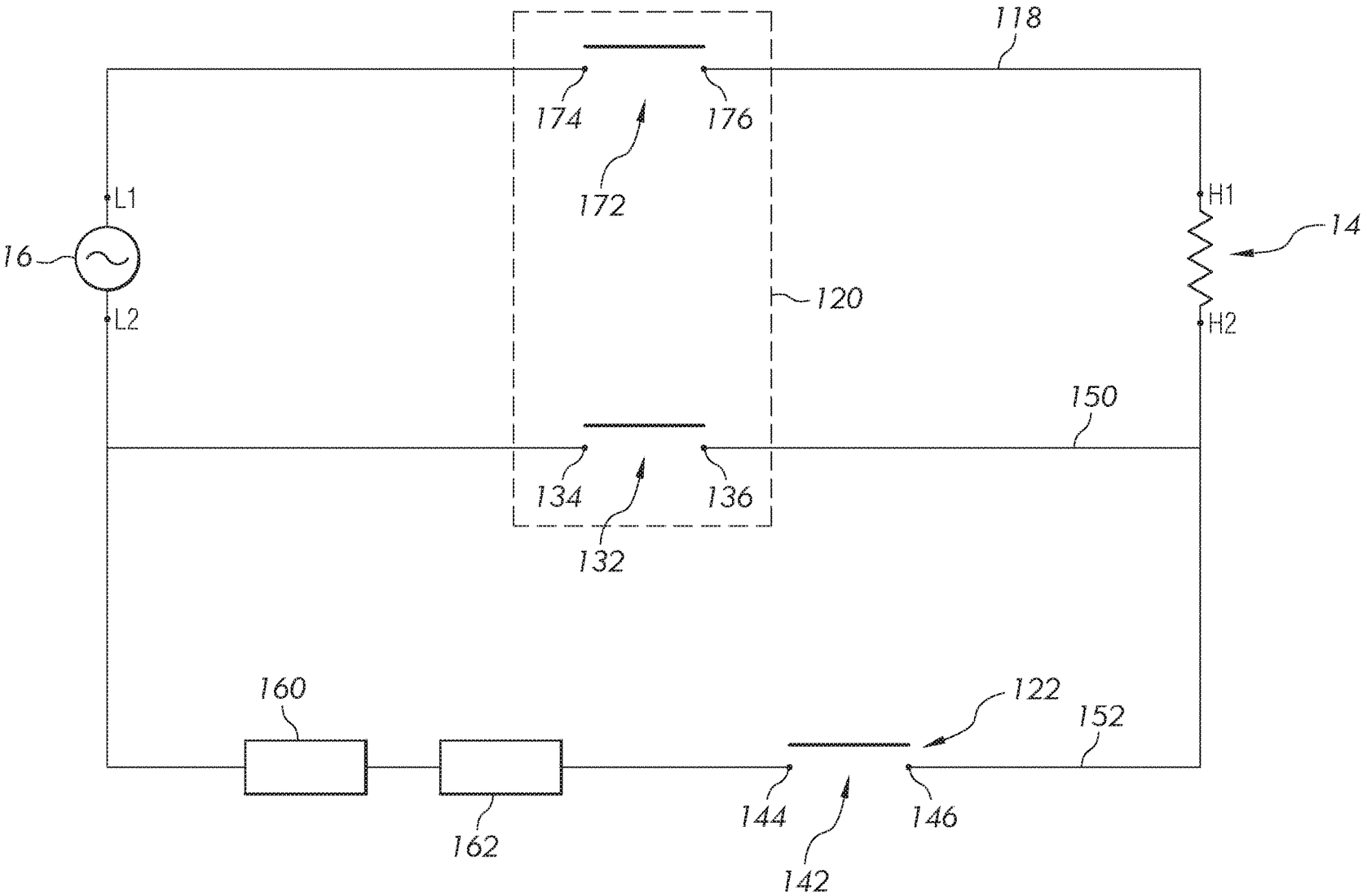
FIG. 23 shows a schematic diagram of the second example power circuit according to still another embodiment.

In other example configurations of the power circuit 118, the first switch assembly 120 will have another set of contacts 172 that includes two contacts 174, 176, as shown in FIG. 23. The set of contacts 172 can be connected in series with both sets of contacts 132, 142 of the first and second switch assemblies 120, 122 along the primary circuit 150 and the bypass circuit 152. In this manner, the set of contacts 172 can be part of both the primary circuit 150 and the bypass circuit 152. In such examples, the first switch assembly 120 will be configured such that when the first switch assembly 120 is engaged (i.e., the set of contacts 132 is closed and/or automatically cycling between an open and closed state), the set of contacts 172 will be persistently closed. Meanwhile, when the first switch assembly 120 is disengaged (i.e., the set of contacts 132 is open and not automatically cycling between an open and closed state), the set of contacts 172 will be persistently open.

In the example configuration shown in FIG. 23, the bypass circuit 152 cannot be closed unless the first switch assembly 120 is engaged and the set of contacts 172 is closed. Accordingly, the configuration shown in FIG. 23 can prevent the heating element 14 from being operated in boost mode by accidentally engaging the second switch assembly 122 while the first switch assembly 120 is disengaged. In other words, in order to operate the heating element 14 in boost mode, a user will have to engage both the first and second switch assemblies 120, 122.

The invention has been described with reference to example embodiments described above. Modifications and alterations will occur to others upon a reading and understanding of this specification. Example embodiments incorporating one or more aspects described above are intended to include all such modifications and alterations insofar as they come within the scope of the appended claims.

What is claimed is:

1. A cooking appliance comprising:

a heating element;

a first switch assembly electrically coupled to the heating element and configured to selectively operate the heating element at a first operating temperature; and a second switch assembly electrically coupled to the heating element and configured to selectively operate the heating element at a second operating temperature that is greater than the first operating temperature, wherein the cooking appliance further includes:

a timer configured to disengage the second switch assembly after the second switch assembly has been engaged for a predetermined amount of time, or a proximity sensor configured to detect the presence or absence of a user within an area proximal to the appliance, wherein when the second switch assembly is engaged, the proximity sensor is configured to disengage the second switch assembly based on the detected presence or absence of the user.

2. The cooking appliance according to claim 1, wherein the first switch assembly is adjustable such that the first operating temperature can be adjusted up to but not beyond a predetermined maximum temperature.

3. The cooking appliance according to claim 2, wherein the predetermined maximum temperature is less than or equal to about 400° C.

4. The cooking appliance according to claim 2, wherein the predetermined maximum temperature is less than a maximum-operable-temperature of the heating element.

5. The cooking appliance according to claim 4, wherein the second operating temperature is a maximum-operable-temperature of the heating element.

6. The cooking appliance according to claim 1, wherein the first switch assembly comprises a first set of contacts and the second switch assembly comprises a second set of contacts, wherein the first set of contacts and the second set of contacts are electrically connected in parallel between a power source and the heating element.

7. The cooking appliance according to claim 1, wherein:

when the first switch assembly is engaged and the second switch assembly is disengaged, cycled power is delivered to the heating element; and when the second switch assembly is engaged, non-cycled power is delivered to the heating element.

8. The cooking appliance according to claim 7, wherein the cooking appliance comprises the timer.

9. The cooking appliance according to claim 7, wherein the cooking appliance comprises the proximity sensor.

10. A cooking appliance comprising:

a heating element;

a first switch assembly electrically coupled to the heating element and configured to selectively operate the heating element at a first operating temperature; and a second switch assembly electrically coupled to the heating element and configured to selectively operate the heating element at a second operating temperature that is greater than the first operating temperature, wherein at least one of the first switch assembly or second switch assembly includes:

a first contact and a second contact;

a bimetal strip configured to electrically connect and disconnect the first and second contacts; and a cam member rotatable about a rotational axis and comprising a cam surface for operative engagement with a cam follower;

wherein the cam surface has a profile dimension that varies about the rotational axis such that rotation of the cam member can cause displacement of the cam follower to thereby adjust an operating temperature of the heating element up to but not beyond a predetermined maximum temperature.

11. The cooking appliance according to claim 10, wherein the cam surface extends circumferentially about the rotational axis.

12. The cooking appliance according to claim 11, wherein the profile dimension is a height of the cam surface from a base plane that is perpendicular to the rotational axis.

13. The cooking appliance according to claim 12, wherein the cam surface comprises a first flat surface portion and a second flat surface portion that is parallel with and axially spaced from the first flat surface portion.

14. The cooking appliance according to claim 13, wherein the cam surface comprises a ramped surface portion that connects the first flat surface portion and the second flat surface portion.

15. The cooking appliance according to claim 13, wherein the cam surface is configured such that when the cam follower engages the first flat surface portion, the first and second contacts are disconnected and when the cam follower engages the second flat surface portion, the operating temperature of the heating element is adjusted to the predetermined maximum temperature.

16. The cooking appliance according to claim 10, wherein the predetermined maximum temperature is less than or equal to about 400° C.

17. The cooking appliance according to claim 10, wherein the predetermined maximum temperature is less than a maximum-operable-temperature of the heating element.

* * * * *